US010299045B2

(12) United States Patent
Xiao et al.

(10) Patent No.: US 10,299,045 B2
(45) Date of Patent: May 21, 2019

(54) MINIATURE SPEAKER

(71) Applicant: AAC Technologies Pte. Ltd., Singapore (SG)

(72) Inventors: Bo Xiao, Shenzhen (CN); Ronglin Linghu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/677,048

(22) Filed: Aug. 15, 2017

(65) Prior Publication Data

US 2018/0302723 A1 Oct. 18, 2018

(30) Foreign Application Priority Data

Apr. 14, 2017 (CN) ..... 2017 2 0395527 U

(51) Int. Cl.

| | |
|---|---|
| ***H04R 9/06*** | (2006.01) |
| ***H04R 9/04*** | (2006.01) |
| ***H04R 7/04*** | (2006.01) |
| ***H04R 7/10*** | (2006.01) |
| *H04R 9/02* | (2006.01) |

(52) U.S. Cl.

CPC ..... *H04R 9/06* (2013.01); *H04R 7/04* (2013.01); *H04R 7/10* (2013.01); *H04R 9/045* (2013.01); *H04R 9/025* (2013.01); *H04R 9/041* (2013.01); *H04R 2499/11* (2013.01)

(58) Field of Classification Search

CPC ..... H04R 9/06; H04R 9/025; H04R 9/045; H04R 7/04; H04R 2499/11; H04R 9/02; H04R 9/041; H04R 1/06

See application file for complete search history.

(56) References Cited

U.S. PATENT DOCUMENTS

| | | | | |
|---|---|---|---|---|
| 5,627,904 A * | 5/1997 | Yang | H04R 1/025 | 381/386 |
| 6,609,666 B1 * | 8/2003 | Blake | B05B 1/3006 | 222/493 |
| 2011/0075880 A1 * | 3/2011 | Kamimura | H04R 1/06 | 381/413 |

(Continued)

*Primary Examiner* — Md S Elahee
*Assistant Examiner* — Angelica M McKinney
(74) *Attorney, Agent, or Firm* — Na Xu; IPro, PLLC

(57) ABSTRACT

The present disclosure provides a miniature speaker, including a vibration unit, a magnetic unit and a housing, the vibration unit includes a first diaphragm, a centering support, a second diaphragm and a voice coil; the centering support includes a first centering support and a second centering support having a conductive portion electrically connected with an external circuit; the second diaphragm includes a first half-diaphragm assembled with the first centering support and a second half-diaphragm assembled with the second centering support, the first half-diaphragm and the second half-diaphragm are asymmetrical configured with respect to each other. Under such structure, it is only necessary to adjust the material and shape of the first half-diaphragm and the second half-diaphragm, swing of the miniature speaker at low frequency can be effectively suppressed, a maximum output sound pressure of the miniature speaker can be effectively improved, and low-frequency sound quality can be improved accordingly.

10 Claims, 4 Drawing Sheets

(56) References Cited

U.S. PATENT DOCUMENTS

| | | | | |
|---|---|---|---|---|
| 2011/0198949 | A1* | 8/2011 | Furuich | H02K 33/16 310/25 |
| 2014/0376766 | A1* | 12/2014 | Chen | H04R 9/02 381/400 |
| 2015/0189442 | A1* | 7/2015 | Zhang | H04R 9/025 381/409 |
| 2016/0021441 | A1* | 1/2016 | Shao | H04R 9/10 381/412 |

* cited by examiner

MINIATURE SPEAKER

TECHNICAL FIELD

The present disclosure relates to a miniature speaker and, particularly, relates to a miniature speaker applied in the field of portable electronic products.

BACKGROUND

With the rapid development of portable devices such as mobile phones, people have an increasing demand on functionality of the portable devices. For example, in order to improve entertainment function of music of a mobile phone, the electroacoustic device is also developing rapidly.

Generally, an ultra-linear miniature speaker of a relating portable device has a lower diaphragm with a symmetrical half-diaphragm structure. Due to limitation of a size of the portable device, the symmetrical half-diaphragm cannot satisfy the demands of a user on single contact mode.

Accordingly, it is necessary to provide a new miniature speaker to solve the above-mentioned problem.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

Technical solutions in exemplary embodiments of the present disclosure will be described more clearly and completely with reference to the accompanying drawings. Obviously, the illustrated exemplary embodiments are merely a part of the embodiments rather than all the embodiments of the present disclosure. Based on the embodiments in the present disclosure, all other embodiments obtained by those skilled in the art without paying any creative efforts shall fall into the protection scope of the present disclosure.

Figure 1:
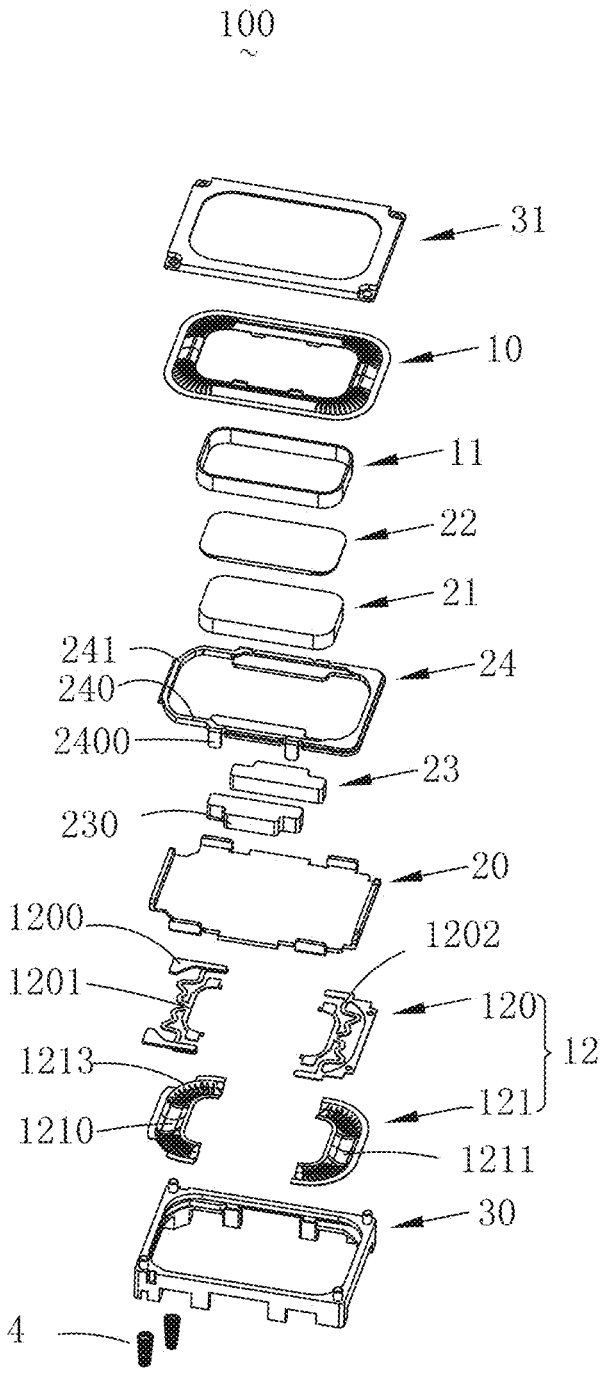
FIG. 1 is an exploded perspective view of a miniature speaker in accordance with an exemplary embodiment of the present disclosure.
Figure 2:
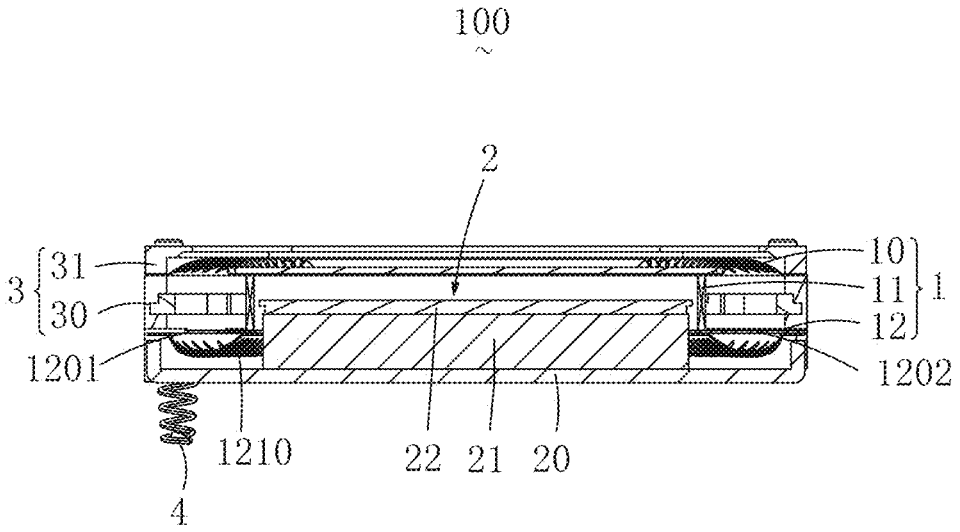
FIG. 2 is a sectional view of a miniature speaker in accordance with an exemplary embodiment of the present disclosure along a long axis direction.

As shown in FIG. 1 and FIG. 2, the present disclosure provides a miniature speaker 100. The miniature speaker 100 includes a vibration unit 1, a magnetic unit 2, a housing 3 and a conductive terminal 4. The housing 3 is configured to accommodate the vibration unit 1 and the magnetic unit 2. The conductive terminal 4 is shaped in a spiral and is assembled with the housing 3.

The vibration unit 1 includes a first diaphragm 10, a voice coil 11 and an elastic supporting member 12. The first diaphragm 10 is fixed at the housing 3. The voice coil 11 is located below the first diaphragm 10 and is configured to drive the first diaphragm 10 to vibrate and sound. The elastic supporting member 12 is located below the voice coil 11 and is fixed at the housing 3 to elastically support the voice coil 11. The elastic supporting member 12 includes a centering support 120 and a second diaphragm 121, and the second diaphragm 121 is assembled with the centering support 120. The voice coil 11 includes two ends, one of the two ends is fixed at the first diaphragm 10, and the other end of the two ends is fixed at the centering support 120 and is electrically connected with the centering support 120.

The centering support 120 is a flexible circuit board including an inner edge and an outer edge. The inner edge is fixed with the voice coil 11, and the outer edge is fixed with the housing 3. The centering support 120 includes a first centering support 1201 and a second centering support 1202 which are arranged opposite to each other. The first centering support 1201 includes a conductive portion 1200, and the conductive portion 1200 is electrically connected with an external circuit. The second diaphragm 121 includes a first half-diaphragm 1210 and a second half-diaphragm 1211, the first half-diaphragm 1210 is assembled with the first centering support 1201, and the second half-diaphragm 1211 is assembled with the second centering support 1202. Balanced support for the voice coil 11 is guaranteed by adjusting damping balance of the elastic supporting member 12 at two sides of the miniature speaker 100, and the damping balance of the elastic supporting member 12 at two sides of the miniature speaker 100 is adjusted by an asymmetrical configuration of the first half-diaphragm 1210 and the second half-diaphragm 1211. Therefore, the miniature speaker 100 can vary in structure to satisfy different structural demands corresponding to different electrical contact modes.

The first half-diaphragm 1210 includes an avoiding portion 1213, and the avoiding portion 1213 is configured to provide space for the conductive portion 1200. The first half-diaphragm 1210 and the second half-diaphragm 1211 are asymmetrically arranged with respect to each other and, specifically, the first half-diaphragm 1210 and the second half-diaphragm 1211 are made of different materials, or the first half-diaphragm 1210 and the second half-diaphragm 1211 are different in shape, so as to achieve the asymmetrical configuration. By merely adjusting the material and shape of the first half-diaphragm 1210 and the second half-diaphragm 1211, swing of the miniature speaker 100 at a low frequency can be effectively suppressed, a maximum low-frequency output sound pressure of the miniature speaker 100 can be effectively improved, and a low-frequency sound quality can be improved accordingly.

The magnetic unit 2 includes a yoke 20, a main magnet 21, a main pole plate 22, an auxiliary magnet 23 and an auxiliary pole plate 24. The yoke 20 is fixed at the housing 3. The main magnet 21 is assembled with the yoke 20. The main pole plate 22 is attached to a surface of the main magnet 21. The auxiliary magnet 23 is attached to the main pole plate 22, and is assembled onto the yoke 20, and is arranged at a peripheral side of the main magnet 21. The auxiliary pole plate 24 is attached to a surface of the auxiliary magnet 23.

Figure 3:
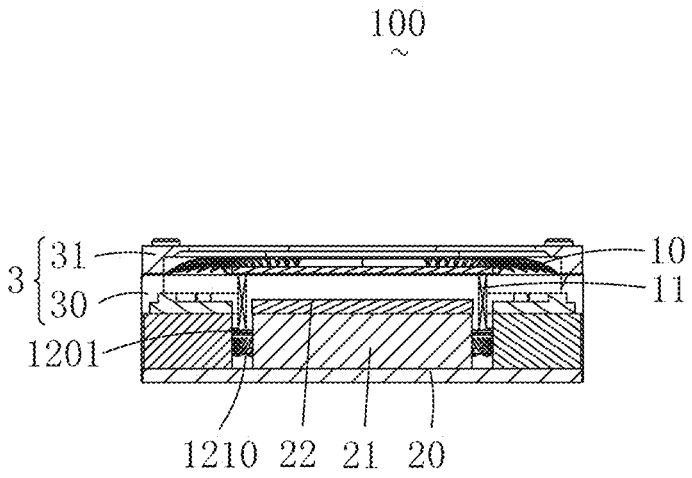
FIG. 3 is a sectional view of a miniature speaker in accordance with an exemplary embodiment of the present disclosure along a short axis direction.

With reference to FIG. 3, the main magnet 21 is arranged at a center of the yoke 20, and the auxiliary magnets 23 are arranged at two opposite sides of the main magnet 21. The auxiliary magnets 23 are spaced from each other and symmetrical arranged with respect to the main magnet 21. The first half-diaphragm 1210 and the second half-diaphragm 1211 are arranged opposite to and spaced from each other with respect to the main magnet 21, and surround the main magnet 21.

The magnetic unit 2 includes two auxiliary magnets 23, and the two auxiliary magnets 23 are respectively located between the first half-diaphragm 1210 and the second half-diaphragm 1211.

Figure 4:
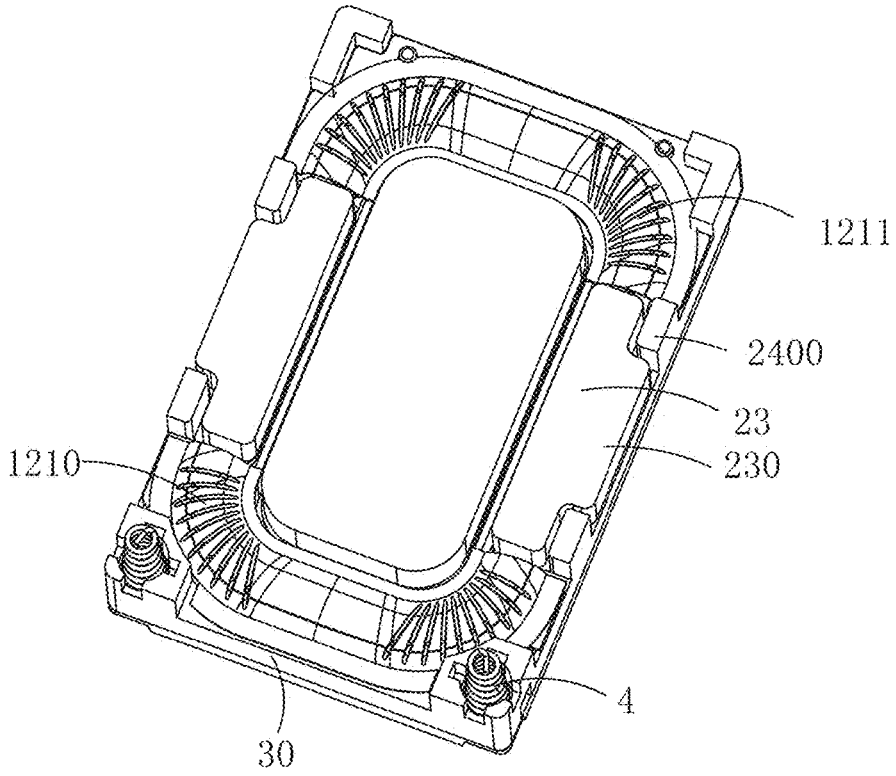
FIG. 4 is a rear view of a miniature speaker after a yoke is removed from the miniature speaker in accordance with an exemplary embodiment of the present disclosure.

With reference to FIG. 4, the auxiliary pole plate 24 includes two long side edges 240 and two short side edges 241. The two long side edges 240 are opposite to each other, and the two short side edges 241 are connected with the two long side edges 240. Each of the two long side edges 240 extends in a direction toward the yoke 20 to form two stopping portions 2400, and the two stopping portions are spaced from each other. Each of the two auxiliary magnets 23 includes a protruding portion 230, and the protruding portion 230 is clamped between the two stopping portions 2400.

The housing 3 includes a frame 30 and a front cover 31. The front cover 31 covers the frame 30. The vibration unit 1 and the magnetic unit 2 are accommodated in the frame 30.

The miniature speaker 100 includes two conductive terminals 4, and the two conductive terminals 4 are embedded in the frame 30. The conductive terminal 4 is fixed on the conductive portion 1200 of the first centering support 1201 and is electrically connected with the conductive portion 1200.

Compared with the relevant art, in the miniature speaker 100 provided by the present application, the first half-diaphragm 1210 and the second half-diaphragm 1211 are arranged in an asymmetrical configuration. By merely adjusting the material and shape of the first half-diaphragm 1210 and the second half-diaphragm 1211, swing of the miniature speaker 100 at a low frequency can be effectively suppressed, a maximum low-frequency output sound pressure of the miniature speaker 100 can be effectively improved, and a low-frequency sound quality can be improved accordingly. Additionally, balanced support for the voice coil 11 is guaranteed by adjusting damping balance of the elastic supporting member 12 at two sides of the miniature speaker 100, and the damping balance of the elastic supporting member 12 at the two sides of the miniature speaker 100 is adjusted by an asymmetrical configuration of the first half-diaphragm 1210 and the second half-diaphragm 1211. Thus, the miniature speaker 100 can vary in structure to satisfy different structural demands corresponding to different electrical contact modes.

The above are merely exemplary embodiments of the present disclosure. It should be noted that, those skilled in the art can make improvements to the present disclosure without departing from the invention concept of the present disclosure, and all these improvements shall fall into the protection scope of the present disclosure.

What is claimed is:

1. A miniature speaker, comprising:

a vibration unit comprising a first diaphragm, a voice coil and an elastic supporting member;

a magnetic unit; and a housing configured to accommodate the vibration unit and the magnetic unit, wherein the first diaphragm is fixed on the housing, the voice coil is located below the first diaphragm and is configured to drive the first diaphragm to vibrate and sound; the elastic supporting member is located below the voice coil and is fixed at the housing to elastically support the voice coil;

wherein the elastic supporting member comprises a centering support and a second diaphragm assembled with the centering support; the centering support comprises a first centering support and a second centering support corresponding to the first centering support; the voice coil is electrically connected with an external circuit through the first centering support; the second diaphragm comprises a first half-diaphragm and a second half-diaphragm, the first half-diaphragm is assembled with the first centering support, the second half-diaphragm is assembled with the second centering support, and the first half-diaphragm and the second half-diaphragm are arranged in an asymmetrical configuration.

2. The miniature speaker as described in claim 1, wherein the first centering support comprises a conductive portion, and the conductive portion is electrically connected with the external circuit; the first half-diaphragm comprises an avoiding portion, and the avoiding portion is configured to provide space for the conductive portion.

3. The miniature speaker as described in claim 2, further comprising a conductive terminal, the conductive terminal is shaped in a spiral and is assembled with the housing, and the conductive terminal is electrically connected with the conductive portion of the first centering support.

4. The miniature speaker as described in claim 1, wherein the centering support is a flexible circuit board.

5. The miniature speaker as described in claim 1, wherein the centering support comprises an inner edge and an outer edge, the inner edge is fixed with the voice coil, and the outer edge is fixed with the housing.

6. The miniature speaker as described in claim 1, wherein the magnetic unit comprises a yoke, a main magnet, a main pole plate, an auxiliary magnet and an auxiliary pole plate; the yoke is fixed at the housing, the main magnet is assembled with the yoke, the main pole plate is attached to a surface of the main magnet, the auxiliary magnet is assembled on the yoke and is arranged at a peripheral side of the main magnet, and the auxiliary pole plate is attached to a surface of the auxiliary magnet.

7. The miniature speaker as described in claim 6, wherein the auxiliary magnet is arranged between the first half-diaphragm and the second half-diaphragm.

8. The miniature speaker as described in claim 6, wherein the auxiliary pole plate comprises two long side edges and two short side edges, the two long side edges are opposite to each other, and the two short side edges are connected with the two long side edges; each of the two long side edges extends in a direction toward the yoke to form two stopping portions, and the two stopping portions are spaced from each other; the auxiliary magnets comprises a protruding portion clamped between the two stopping portions.

9. The miniature speaker as described in claim 1, wherein the first half-diaphragm and the second half-diaphragm are made of different materials.

10. The miniature speaker as described in claim 1, wherein the first half-diaphragm and the second half-diaphragm are different in shape.

* * * * *